US008899414B2

(12) United States Patent
Chatelain et al.

(10) Patent No.: US 8,899,414 B2
(45) Date of Patent: Dec. 2, 2014

(54) SLIDE AND SHELL CONTAINER HAVING TAMPER EVIDENT SEAL

(75) Inventors: Lucas Chatelain, Savigny (CH); Philippe Bourgoin, Echallens (CH); Roger Nuetzi, Harkingen (CH); Michael Barth, Liestal (CH)

(73) Assignee: Philip Morris USA Inc., Richmond, VA (US)

( * ) Notice: Subject to any disclaimer, the term of this patent is extended or adjusted under 35 U.S.C. 154(b) by 238 days.

(21) Appl. No.: 13/070,888

(22) Filed: Mar. 24, 2011

(65) Prior Publication Data

US 2011/0232236 A1 Sep. 29, 2011

(30) Foreign Application Priority Data

Mar. 25, 2010 (EP) ..... 10250570

(51) Int. Cl.
*B65D 85/10* (2006.01)
*B65D 5/38* (2006.01)

(52) U.S. Cl.
CPC ..... *B65D 5/38* (2013.01); *B65D 85/1054* (2013.01)
USPC ..... 206/267; 229/125.125

(58) Field of Classification Search
USPC ..... 206/267, 245, 247, 264, 270, 271, 273, 206/274, 275, 265, 248, 242, 254, 259; 220/266, 8; 229/102, 103.3, 103.2, 229/120.011, 120.01, 220, 125.125, 185.1, 229/210, 87.13, 240, 121, 242, 241
See application file for complete search history.

(56) References Cited

U.S. PATENT DOCUMENTS

| | | | | | |
|---|---|---|---|---|---|
| 1,943,074 | A | * | 1/1934 | Heyman | 229/125.38 |
| 2,930,518 | A | * | 3/1960 | Cottrill | 229/240 |
| 3,400,874 | A | * | 9/1968 | Shimada et al. | 206/250 |
| 3,918,631 | A | * | 11/1975 | Hackenberg | 229/208 |
| 4,049,117 | A | * | 9/1977 | Grimm | 206/270 |
| 4,049,190 | A | * | 9/1977 | O'Neill | 229/224 |
| 4,083,454 | A | * | 4/1978 | O'Neill | 229/240 |
| 4,524,900 | A | * | 6/1985 | Salminen | 229/220 |

(Continued)

FOREIGN PATENT DOCUMENTS

| | | |
|---|---|---|
| DE | 570351 C | 2/1933 |
| DE | 20 2005 011 562 U1 | 9/2005 |

(Continued)

OTHER PUBLICATIONS

International Search Report and Written Opinion dated Jul. 4, 2011 for PCT/EP2011/001455.

(Continued)

*Primary Examiner* — Jacob K Ackun
*Assistant Examiner* — Jenine Pagan
(74) *Attorney, Agent, or Firm* — Buchanan Ingersoll & Rooney PC

(57) ABSTRACT

A slide and shell container includes an outer shell and an inner slide mounted within the outer shell. The outer shell and the inner slide are detachably connected to each other along one or more lines of weakness. Upon separation of the outer shell and inner slide along the one or more lines of weakness, the inner slide becomes moveable within the outer shell between a closed slide position and an open slide position. The two or more lines of weakness define an integral opening strip which is separable from the container in order to separate the outer shell and the inner slide.

14 Claims, 3 Drawing Sheets

(56) References Cited

U.S. PATENT DOCUMENTS

| | | | | |
|---|---|---|---|---|
| 4,524,901 | A | 6/1985 | Tikka | |
| 7,273,145 | B2 * | 9/2007 | Focke et al. | 206/267 |
| 2008/0128301 | A1 * | 6/2008 | Bourgoin et al. | 206/268 |

FOREIGN PATENT DOCUMENTS

| | | | |
|---|---|---|---|
| EP | 1 927 548 | A1 | 6/2008 |
| WO | WO 2009/027822 | A2 | 3/2009 |
| WO | WO 2009/027833 | A2 | 3/2009 |

OTHER PUBLICATIONS

European Search Report dated Jul. 30, 2010 for European Patent Application No. 10 25 0570.

International Preliminary Report on Patentability Issued Oct. 4, 2012 for PCT/EP2011/001455.

* cited by examiner

SLIDE AND SHELL CONTAINER HAVING TAMPER EVIDENT SEAL

CROSS REFERENCE TO RELATED APPLICATION

This application corresponds to, and claims priority under 35 U.S.C. §119 and 37 C.F.R. §1.55 to European Application No. 10250570.8, filed Mar. 25, 2010, the entire content of which is hereby incorporated by reference.

WORKING ENVIRONMENT

It is known to package consumer goods in containers including an outer shell or sleeve and an inner slide or tray in which the consumer goods are housed and which is slidable within the outer shell. To remove consumer goods from such containers, a consumer slides the inner slide from an initial position within the outer shell to an open lid position in which the inner slide projects outwardly from the outer shell, in order to partially expose an open end or side of the inner slide.

It is known to provide a slide and shell container with a tamper evident seal or closure. For example, U.S. Pat. No. 4,524,901 discloses a two-piece box having an outer part and an inner part that are attached to each other by means of a tear strip. In order to gain access to the consumer goods within the inner part of the container, the outer part and the inner part must be separated from each other by removal of the tear strip. Due to the construction of the blank and the machinery used to manufacture this two-piece box from the blank, the outer part is just a sleeve without top or bottom. Thus, the structural strength of the outer part of this assembled two-piece box is limited, particularly in the open position of the two-piece box.

It would be desirable to provide an improved slide and shell container having a tamper evident seal, which must be broken before the inner slide can be removed from within the outer shell. It would be particularly desirable if such a slide and shell container could be assembled using conventional methods and apparatus and shows an improved structural strength over known containers.

BRIEF DESCRIPTION OF THE DRAWINGS

The invention will be further described, by way of example only, with reference to the accompanying drawings wherein like reference numerals are applied to like elements and wherein.

SUMMARY OF SELECT EMBODIMENTS

Figure 1:
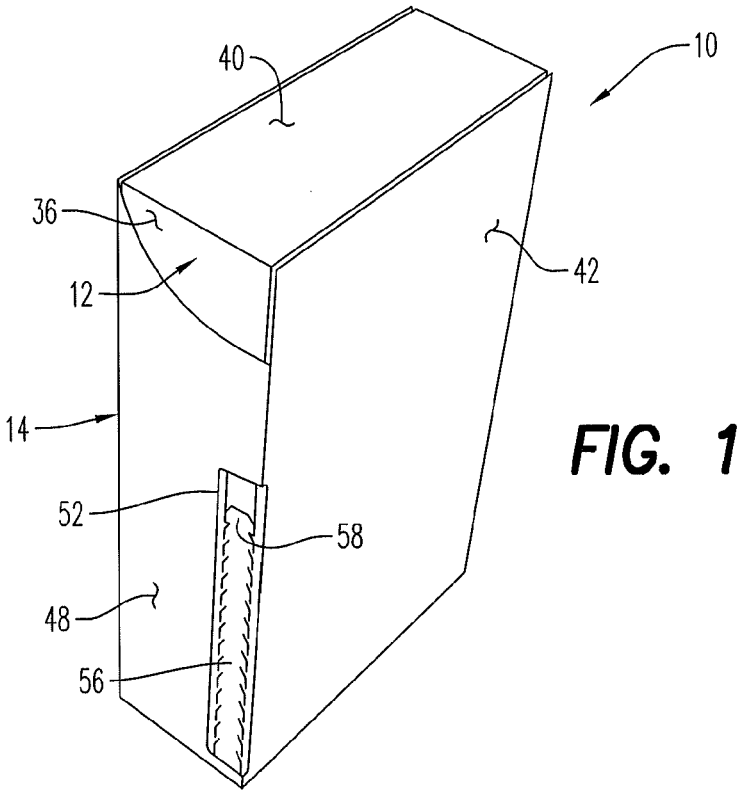
FIG. 1 shows a perspective front view of a container with the lines of weakness still intact and the inner slide in a closed position.

In a preferred embodiment, a slide and shell container includes an outer shell including a shell front wall, a shell back wall, a shell bottom wall, a first shell side wall and a second shell side wall, and an inner slide. Preferably, the inner slide is mounted within the outer shell and includes a slide front wall, a slide back wall, a first slide side wall and a second slide side wall. Also preferably, the outer shell and the inner slide are detachably connected to each other along one or more lines of weakness. Upon separation of the outer shell and inner slide along the one or more lines of weakness, the inner slide becomes moveable within the outer shell between a closed slide position and an open slide position.

In the preferred embodiment, the outer shell and inner slide are detachably connected to each other along two or more lines of weakness defining an integral opening strip which is separable from the container in order to separate the outer shell from the inner slide.

Also in the preferred embodiment, the inner slide includes a box and a hinge lid connected to the box about a hinge line. In the closed slide position the hinge lid is retained in a closed position by the outer shell and in the open slide position the hinge lid is moveable to an open position. Moreover, prior to separation of the outer shell and the inner slide along the one or more lines of weakness, the inner slide is held in the closed slide position.

Preferably, the inner slide further includes a bottom slide wall. Also preferably, the slide and shell container includes retention means for preventing removal of the inner slide from the outer shell. In the preferred embodiment, the retention means includes at least one retention flap provided on the inner slide which is capable of engaging with the outer sleeve to prevent movement of the inner slide beyond the open slide position.

Preferably, the outer shell and inner slide are formed together of a single laminar blank including the one or more lines of weakness. Also preferably, an opening tab is provided along the one or more lines of weakness. In the preferred embodiment, the inner slide houses a plurality of smoking articles.

In another preferred embodiment, a laminar blank for forming a slide and shell container is provided. The slide and shell container includes an outer shell and an inner shell. In the preferred embodiment, the outer shell includes a shell front wall, a shell back wall, a shell bottom wall, a first shell side wall and a second shell side wall. Preferably, the inner slide is mounted within the outer shell and includes a slide front wall, a slide back wall, a first slide side wall and a second slide side wall. Also preferably, the laminar blank includes a slide-defining portion for forming the inner slide; and a shell-defining portion for forming the outer shell.

In the preferred embodiment, the slide-defining portion and the shell-defining portion are connected to each other along one or more lines of weakness. Preferably, the inner slide defining portion includes a slide front wall panel, a slide back wall panel, a first slide wall panel, and a second slide wall panel. Also preferably, the outer shell defining portion includes a shell front wall panel, a shell back wall panel, a shell bottom wall panel, a first shell side wall panel, and a second shell side wall panel.

Also in the preferred embodiment, the laminar blank can also include a shell inner bottom wall panel and a shell outer bottom wall panel. The laminar blank can further include a slide inner bottom wall panel and a slide outer bottom wall panel. Preferably, the shell inner bottom wall panel includes a cut out portion and the slide outer bottom wall panel is shaped such that upon assembly of the laminar blank to form a container, the slide outer bottom wall panel passes through the cut out portion of the shell inner bottom wall panel.

In yet another embodiment, a method for forming a slide and shell container from the laminar blank includes steps of: partially assembling the container by folding the inner slide defining portion and the outer shell defining portion along the longitudinal fold lines provided therein; inserting consumer goods into the inner slide defining portion through an open end thereof; folding the slide inner bottom wall panel and the shell inner bottom wall panel inwards; applying adhesive to the slide inner bottom wall panel and the shell inner bottom wall panel; and folding the slide outer bottom wall panel and the shell outer bottom wall panel inwards such that the slide outer bottom wall panel passes through the cut out portion in the shell inner bottom wall panel to adhere to the slide inner bottom wall panel and the shell outer bottom wall panel adheres to the shell inner bottom wall panel.

DETAILED DESCRIPTION

The present invention relates to a novel slide and shell container for consumer goods. The container finds particular application as a container for elongate smoking articles, such as cigarettes.

According to a preferred embodiment, there is provided a slide and shell container for consumer goods including an outer shell and an inner slide for housing the consumer goods. Preferably, the inner slide is mounted within the outer shell. Also preferably, the outer shell includes a shell front wall, a shell back wall, a shell bottom wall, a first shell side wall and a second shell side wall. In the preferred embodiment, the inner slide includes a slide front wall, a slide back wall, a first slide side wall and a second slide side wall. Moreover, the outer shell and the inner slide are detachably connected to each other along one or more lines of weakness. Upon separation of the outer shell and inner slide along the one or more lines of weakness, the inner slide becomes moveable within the outer shell between a closed slide position and an open slide position.

As used herein, the terms "front", "back", "upper, "lower", "side", "top", "bottom", "left", "right" and other terms used to describe relative positions of the components of the container refer to the container in an upright position with the opening through which the consumer goods are removed at the top end.

As used herein, the term "longitudinal" refers to a direction from bottom to top or vice versa. The term "transverse" refers to a direction perpendicular to the longitudinal direction.

As used herein, the terms "upwards" and "downwards" are used to describe the relative movement of the inner slide and outer shell of the container when the container is in an upright position.

As used herein, the term "line of weakness" describes a line in a sheet of material, such as paper or card, along which the material has been weakened through removal of some of the material along that line. This facilitates the tearing or breakage of the sheet material along a desired line. The one or more lines of weakness in the container may be, for example, score lines, or lines of perforations.

In an alternative embodiment of the container, the lines of weakness are broken during the manufacturing process. This means that while the inner slide and outer shell can be formed from a single laminar blank, the consumer is not required to break the lines of weakness in order to access the consumer goods in the inner slide.

However, more preferably, the lines of weakness are intact at the point of sale of the filled container and must be broken by the consumer in order to access the consumer goods.

In the preferred embodiment, prior to use, the inner slide and outer shell are attached to each other along the one of more lines of weakness. Until the lines of weakness are broken, this attachment between the two portions substantially prevents movement of the inner slide within the outer shell. Preferably, the container is initially provided with the inner slide in its closed position, fully within the outer shell. It is therefore not possible to gain access to the consumer goods within the inner slide without detaching the inner slide from the outer shell along the line or lines of weakness.

The lines of weakness therefore provide the container with a tamper evident seal, which enables the consumer to tell whether or not the container has been previously opened or tampered with in any way. The presence of an unbroken seal indicates that the inner slide has not yet been opened and the consumer goods have not been accessed. It may also reflect to the consumer that the goods within the container are still fresh, since the packaging has not yet been opened.

Upon separation of the inner slide and outer shell through the breakage of the one or more lines of weakness, the inner slide becomes free to move relative to the outer shell. The movement of the inner slide to its open position is therefore possible, in order to gain access to the consumer goods.

In the preferred embodiment, the one or more lines of weakness may be provided at any suitable position on the container and may extend across all or a part of one or more of the walls of the container. Preferably, the one or more lines of weakness are provided in a longitudinal direction, substantially parallel to the vertical edges of the outer shell. In other embodiments, the one or more lines of weakness are provided in a longitudinal direction on one of the side walls of the container.

Preferably, the outer shell and inner slide may be detachably connected along a single line of weakness. In such embodiments, the line of weakness is broken without the removal of any portion of the container.

However, in the preferred embodiment, the outer shell and inner slide are detachably connected to each other along two or more lines of weakness defining an integral opening strip which is separable from the container in order to separate the outer shell and the inner slide. Preferably, the opening strip must be completely removed from the container before the inner slide is able to move relative to the outer shell. Also preferably, the container includes two lines of weakness, one on each side of the opening strip.

In the preferred embodiment, suitable means such as a cut out or tab are provided at the one or more lines of weakness to facilitate the breakage thereof. For example, where an integral opening strip is provided, one or both ends of the strip may be provided with an opening tab to make it easier for the consumer to grasp the strip. The opening tab or tabs are connected to the integral opening strip but not to the remainder of the container, such that they can be readily lifted away from the surface of the container. Alternatively, where a single line of weakness is provided, a cut out or slightly protruding tab may be provided midway along the line of weakness. This provides an access point at which the consumer can apply sufficient force to break the line of weakness.

In the preferred embodiment, the one or more lines of weakness are preferably provided such that following separation of the inner slide and outer shell along the lines of weakness, the inner slide and outer shell remain fully intact and each retains its structural integrity. For example, preferably none of the integral wall panels of the inner slide or outer shell are split or separated from each other upon breakage of the lines of weakness.

Since the one or more lines of weakness are provided between the inner shell and outer slide, the lines of weakness will typically be positioned inside the outer shell. In order for the one or more lines of weakness to be accessible from the outside of the container, the outer shell is therefore preferably provided with an elongate cut out or window through which the lines of weakness can be accessed.

Preferably, the inner slide of the container includes one or more openings through which the consumer goods housed therein can be accessed. Also preferably, the inner slide includes a box and a hinge lid connected to the box along a hinge line. In the closed position of the inner slide, the hinge lid is retained in a closed position since the hinge line is covered by the back wall of the outer shell. In the open position, the hinge lid may be pivoted about the hinge line in order to move the hinge lid to an open position and access the consumer goods within the inner shell.

Preferably, the inner slide includes a bottom wall covering at least a part of the bottom face of the inner slide. This may help to prevent the consumer articles falling through the bottom of the inner slide. It also ensures that the consumer goods are lifted out of the outer shell along with the inner slide, as the inner slide is moved to the open slide position. Furthermore, the inclusion of a bottom wall increases the structural stability and rigidity of the inner slide.

If desired, the container may be provided with means for automatically opening the hinge lid as the inner slide is moved to its open position. Suitable means are described, for example, in WO-A-2009/027833.

Preferably, the top side of the outer shell is preferably open to allow access to the inner slide and movement of the inner slide out of the outer shell into its open position. However, an openable lid or flap may be provided at the top wall of the outer shell if desired.

Also preferably, the upper edges of the outer shell are provided with one or more cut outs through which the inner slide can be grasped in order to move it between the closed and open positions. The cut outs may be any desired shape and may advantageously be used to reflect the branding of the consumer goods housed within the inner slide.

In the preferred embodiment, the container can also include retention means for preventing removal of the inner slide from the outer shell and for limiting the movement of the inner slide relative to the outer shell. Particularly preferably, the retention means ensure that the inner slide cannot be pushed out of the outer shell beyond its open position.

Preferably, the retention means includes at least one retention tab provided on the inner slide which is capable of engaging with the outer sleeve to prevent movement of the inner slide beyond the open position. The at least one retention tab may engage with a corresponding tab provided on the inside of the outer sleeve. Preferably, the engagement of the tabs prevents further movement of the inner slide in a particular direction. Alternatively, the outer sleeve may include one or more cut outs on the inner surface thereof. Moreover, the at least one retention tab is restrained to moving within the one or more cut outs. Preferably, the wall of the outer sleeve including the one or more cut outs is formed of an inner wall panel and an outer wall panel. Also preferably, the one or more cut outs are provided in the inner wall panel only, so that they are not visible from the outside of the container.

In the preferred embodiment, the container may be formed from any suitable materials including, but not limited to, cardboard, paperboard, plastic, metal, or combinations thereof. Preferably, the outer shell and inner slide are each formed from one or more folded laminar cardboard blanks. Also preferably, the cardboard has a weight ranging from about 100 grams per square meter (gsm) to about 350 grams per square meter.

Preferably, the container may be in the shape of a generally rectangular parallelepiped, with right-angled longitudinal and right-angled transverse edges. Alternatively, the container may include one or more generally rounded longitudinal edges, generally rounded transverse edges, generally bevelled longitudinal edges or generally bevelled transverse edges, or combinations thereof. For example, the container according to the invention may include, without limitation:

One or two longitudinal generally rounded or generally bevelled edges on the front wall, and/or one or two longitudinal generally rounded or generally bevelled edges on the back wall.

One or two transverse generally rounded or generally bevelled edges on the front wall, and/or one or two transverse generally rounded or generally bevelled edges on the back wall.

One longitudinal generally rounded edge and one longitudinal generally bevelled edge on the front wall, and/or one transverse generally rounded edge and one transverse generally bevelled edge on the back wall.

One or two transverse generally rounded or generally bevelled edges on the front wall and one or two longitudinal generally rounded or generally bevelled edges on the front wall.

Two longitudinal generally rounded or generally bevelled edges on a first side wall or two transverse generally rounded or generally bevelled edges on the second side wall.

Where the container includes one or more generally rounded edges and is made from one or more laminar blanks, preferably the blanks include three, four, five, six or seven scoring lines or creasing lines to form each rounded edge in the assembled container. The scoring lines or creasing lines may be either on the inside of the container or on the outside of the container. Preferably, the scoring lines or creasing lines are spaced from each other by a distance ranging from about 0.3 millimeters (mm) to about 4 mm.

Preferably, the spacing of the creasing lines or scoring lines is a function of the thickness of the laminar blank. Also preferably, the spacing between the creasing lines or scoring lines ranges from about 0.5 to about 4 times larger than the thickness of the laminar blank.

Where the container includes one or more generally bevelled edge, preferably the generally bevelled edge has a width ranging from about 1 mm to about 10 mm, preferably ranging from about 2 to about 6 mm. Alternatively, the container may include a double bevel formed by three parallel creasing or scoring lines that are spaced such that two distinct bevels are formed on the edge of the container.

Where the container includes a generally bevelled edge and is made from one or more laminar blanks, the bevel may be formed by two parallel creasing lines or scoring lines in the laminar blank. The creasing lines or scoring lines may be arranged symmetrically to the edge between a first wall and a second wall. Alternatively, the creasing lines or scoring lines may be arranged asymmetrically to the edge between the first wall and the second wall, such that the bevel reaches further into the first wall of the container than into the second wall of the container.

Alternatively, the container may have a non-rectangular transversal cross section, for example polygonal such as generally triangular or generally hexagonal, generally semi-oval or generally semi-circular.

Preferably, the container finds particular application as a pack for elongate smoking articles such as, for example, cigarettes, cigars or cigarillos. It will be appreciated that through appropriate choices of the dimensions thereof, the container may be designed for different numbers of conventional size, king size, super-king size, slender or very slender cigarettes. Alternatively, other consumer goods may be housed inside the container.

Through an appropriate choice of the dimensions thereof, the container may be designed to hold different total numbers of smoking articles, or different arrangements of smoking articles. For example, through an appropriate choice of the dimensions thereof, the container may be designed to hold a total of between ten and thirty smoking articles.

The smoking articles may be arranged in different collations, depending on the total number of smoking articles. For example, the smoking articles may be arranged in a single row of six, seven, eight, nine or ten. Alternatively, the smoking articles may be arranged in two or more rows. The two or more rows may contain the same number of smoking articles. For example, the smoking articles may be arranged in: two rows of five, six, seven, eight, nine or ten; three rows of five or seven; or four rows of four, five or six. Alternatively, the two or more rows may include at least two rows containing different number of smoking articles to each other. For example, the smoking articles may be arranged in: a row of five and a row of six (5-6); a row of six and a row of seven (6-7); a row of seven and a row of eight (7-8); a middle row of five and two outer rows of six (6-5-6); a middle row of five and two outer rows of seven (7-5-7); a middle row of six and two outer rows of five (5-6-5); a middle row of six and two outer rows of seven (7-6-7); a middle row of seven and two outer rows of six (6-7-6); a middle row of nine and two outer rows of eight (8-9-8); or a middle row of six with one outer row of five and one outer row of seven (5-6-7).

In the preferred embodiment, the container may hold smoking articles of the same type or brand, or of different types or brands. In addition, both filterless smoking articles and smoking articles with various filter tips may be contained, as well as smoking articles of differing length (for example, ranging from about 40 mm to about 180 mm), diameter (for example, ranging from about 4 mm to about 9 mm). In addition, the smoking articles may differ in strength of taste, resistance to draw and total particulate matter delivery. Preferably, the dimensions of the container are adapted to the length of the smoking articles, and the collation of the smoking articles. Typically, the outer dimensions of the container range from about 0.5 mm to about 5 mm larger than the dimensions of the bundle or bundles of smoking articles housed inside the container.

The length, width and depth of the container may be such that, in the closed lid position, the resultant overall dimensions of the container are similar to the dimensions of a typical disposable hinge-lid pack of twenty cigarettes.

Preferably, the container has a height ranging from about 60 mm to about 150 mm, more preferably a height ranging from about 70 mm to about 125 mm. Also preferably, the height is measured from the bottom wall to the top wall of the container.

In the preferred embodiment, the container has a width ranging from about 12 mm to about 150 mm, more preferably a width ranging from about 70 mm to about 125 mm. Preferably, the width is measured from one side wall to the other side wall of the container.

Also preferably, the container has a depth ranging from about 6 mm to about 150 mm, more preferably a depth ranging from about 12 mm to about 25 mm wherein the depth is measured from the front wall to the back wall of the container (including the hinge between box and lid).

Preferably, the ratio of the height of the container to the depth of the container ranges from about 0.3 to 1 to about 10 to 1, more preferably ranges from about 2 to 1 to about 8 to 1, most preferably ranges from about 3 to 1 to about 5 to 1

Preferably, the ratio of the width of the container to the depth of the container ranges from about 0.3 to 1 to about 10 to 1, more preferably ranges from about 2 to 1 to about 8 to 1, most preferably ranges from about 2 to 1 to about 3 to 1.

Preferably, the ratio of the height of the lid back wall to the height of the box back wall of the outer sleeve ranges from about 0 to 1 (hinge located at the top edge of the container) to about 1 to 1, more preferably, ranges from about 1 to 5 to about 1 to 10, most preferably, ranges from about 1 to 6 to about 1 to 8.

Preferably, the ratio of the height of the lid front wall of the outer sleeve to the height of the box front wall of the outer sleeve ranges from about 1 to 0 (lid covering the entire front wall) to about 1 to 10, more preferably, ranges from about 1 to 1 to about 1 to 5, most preferably, ranges from about 1 to 2 to about 1 to 3.

Where the container includes smoking articles, the container may further include waste-compartments (for example for ash or butts) or other consumer goods, for example matches, lighters, extinguishing means, breath-fresheners or electronics. The other consumer goods may be attached to the outside of the container, contained within the container along with the smoking articles, in a separate compartment of the container or combinations thereof.

In the preferred embodiment, the exterior surfaces of the container may be printed, embossed, debossed or otherwise embellished with manufacturer or brand logos, trade marks, slogans and other consumer information and indicia.

Where the inner slide of the container contains a bundle of cigarettes or other elongate smoking articles, the smoking articles are preferably wrapped in an inner liner of, for example, metal foil or metallized paper.

Once filled, the container may be shrink wrapped or otherwise over wrapped with a transparent polymeric film of, for example, high or low density polyethylene, polypropylene, oriented polypropylene, polyvinylidene chloride, cellulose film, or combinations thereof in a conventional manner. Where the container is over wrapped, the over wrapper may include one or more a tear tapes. In addition, the over wrapper may be printed with images, consumer information or other data.

Preferably, the inner slide and outer shell of the container may be formed from separate laminar blanks which are connected to each other in some way, with the one or more lines of weakness provided in the connecting portion. The connecting portion may be an integral part of the inner slide or outer shell, or may be a completely separate portion that has been attached to the inner slide and outer shell during assembly.

Preferably, the container is formed from a single laminar blank, which is provided with one or more lines of weakness between a slide-defining portion for forming the inner slide and a shell-defining portion for forming the outer shell.

In another embodiment, a laminar blank for forming the container as described above includes a slide-defining portion and a shell-defining portion connected to each other along one or more lines of weakness. Preferably, the slide-defining portion includes a slide front wall panel, a slide back wall panel a first slide wall panel and a second slide wall panel and the shell-defining portion includes a shell front wall panel, a shell back wall panel, a shell bottom wall panel, a first shell side wall panel and a second shell side wall panel.

In the preferred embodiment of the laminar blank and container, the blank includes a shell inner bottom wall panel and a shell outer bottom wall panel for forming the outer shell bottom wall. Preferably, the blank also includes a slide inner bottom wall panel and a slide outer bottom wall panel for forming the inner slide bottom wall. Also preferably, the bottom wall of each of the inner slide and outer shell are therefore formed of two panels, which are adhered together during assembly of the container.

In the preferred embodiment, the inner bottom wall panels of the inner slide and outer shell are connected to the back wall of the inner slide and the outer shell, respectively, such that the hinge lines about which the inner bottom wall panels are folded during assembly substantially coincide with each other when the inner slide is in place within the outer shell. This means that both panels can be folded into position during assembly of the container in a single folding motion. Similarly, the outer bottom wall panels of the inner slide and outer shell are connected to the front walls of the inner slide and outer shell, respectively, such that the hinge lines about which the outer bottom wall panels are folded during assembly substantially coincide with each other.

Preferably, the shell inner bottom wall panel includes a cut out portion which exposes a portion of the underlying slide inner bottom wall panel when the container is at least partially assembled. The slide outer bottom wall panel preferably has a shape that substantially corresponds to the shape of the cut out portion in the shell inner bottom wall panel, or is smaller than the cut out portion. In addition, the slide outer bottom wall panel is preferably positioned such that it coincides with the cut out portion when the container is assembled.

This arrangement enables the slide outer bottom wall panel to pass through the cut out portion in the shell inner bottom wall panel during assembly such that it can adhere to the slide inner bottom wall panel in order to form the bottom wall of the inner slide. Without the provision of the cut out portion, the shell inner bottom wall panel would overlie and cover the slide inner bottom wall panel such that it would not be possible to adhere the panels of both the slide bottom wall and the shell bottom wall using a standard assembly procedure.

The arrangement of the bottom wall panels described above is therefore particularly advantageous since it enables containers in which both the outer shell and inner slide have bottom walls to be assembled using conventional assembly methods and apparatus, as described in more detail below. For example, the containers can be automatically assembled on a standard Bergami® machine, of the type used to assemble conventional packs of smoking articles.

Advantageously, the inclusion of a bottom wall in both the outer shell and the inner slide provides the container with improved rigidity and structural strength.

In another embodiment, a method for assembling the container from a single laminar blank is provided. The laminar blank incorporating the one or more lines of weakness is first partially assembled by folding it along the longitudinal fold lines and gluing the inner slide and outer shell defining portions at their respective side walls, so as to form an open ended sleeve with the inner slide within the outer shell. At this point during the assembly, the inner bottom wall panels of the inner slide and outer shell are overlying each other at one side of the pack while the outer bottom wall panels of the inner slide and outer shell are overlying each other at the opposite side of the pack. The resultant open ended sleeve can advantageously be flattened at this stage for efficient storage or transport.

In the same or a separate process to the partial assembly described above, the consumer goods are then inserted into the inner slide through one of the open ends. As the filled pack progresses through an automatic packing machine, the inner bottom wall panels of the inner slide and outer shell are folded inward towards the consumer goods. Preferably, glue is applied to the outer surface of each of the inner bottom wall panels.

Following the application of the glue, the outer bottom wall panels of the inner slide and outer shell are folded inwards towards their respective inner bottom wall panels so that the outer bottom wall panel of the inner slide is adhered to the inner bottom wall panel of the inner slide and similarly for the outer shell.

This gluing procedure is only possible due to the provision of the cut out in the inner bottom wall panel of the outer shell, which exposes a portion of the underlying slide inner bottom wall panel and through which the slide outer bottom wall panel can pass in order to adhere to the corresponding inner panel.

During assembly of the container, the panels of the blank forming the top walls of the inner slide and outer shell, where present, are automatically folded inwards and glued in the conventional manner.

As shown in FIG. 1, the container 10 is a generally rectangular parallelepiped and includes an outer shell 14 and an inner slide 12 mounted within the outer shell 14. A bundle of smoking articles (not shown) is housed in the inner slide 12 of the container 10.

Figure 3:
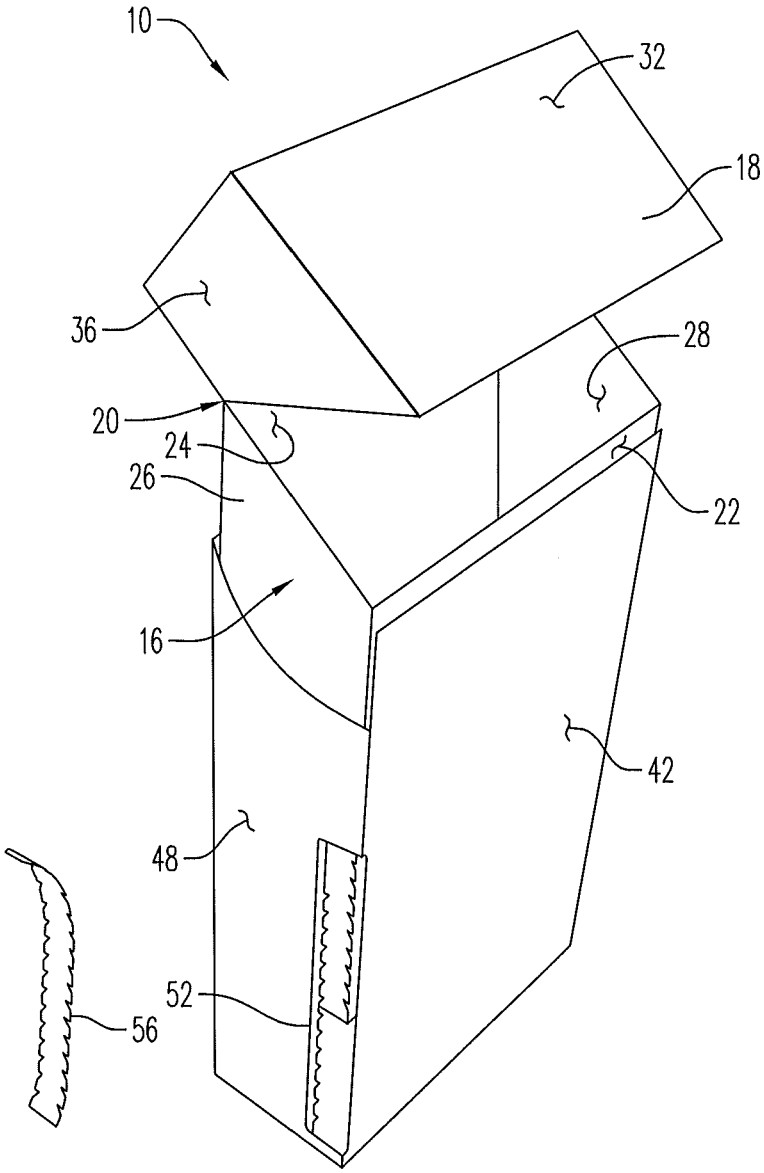
FIG. 3 shows a perspective front view of the container of FIGS. 1 and 2 with the inner slide in an open slide position.

Preferably, as shown in FIG. 3, the inner slide 12 includes a box 16 and a hinge lid 18 connected to the box 16 along a hinge line 20 extending substantially horizontally across the back wall of the inner slide 12 at a small distance from the top of the inner slide 12.

Figure 4:
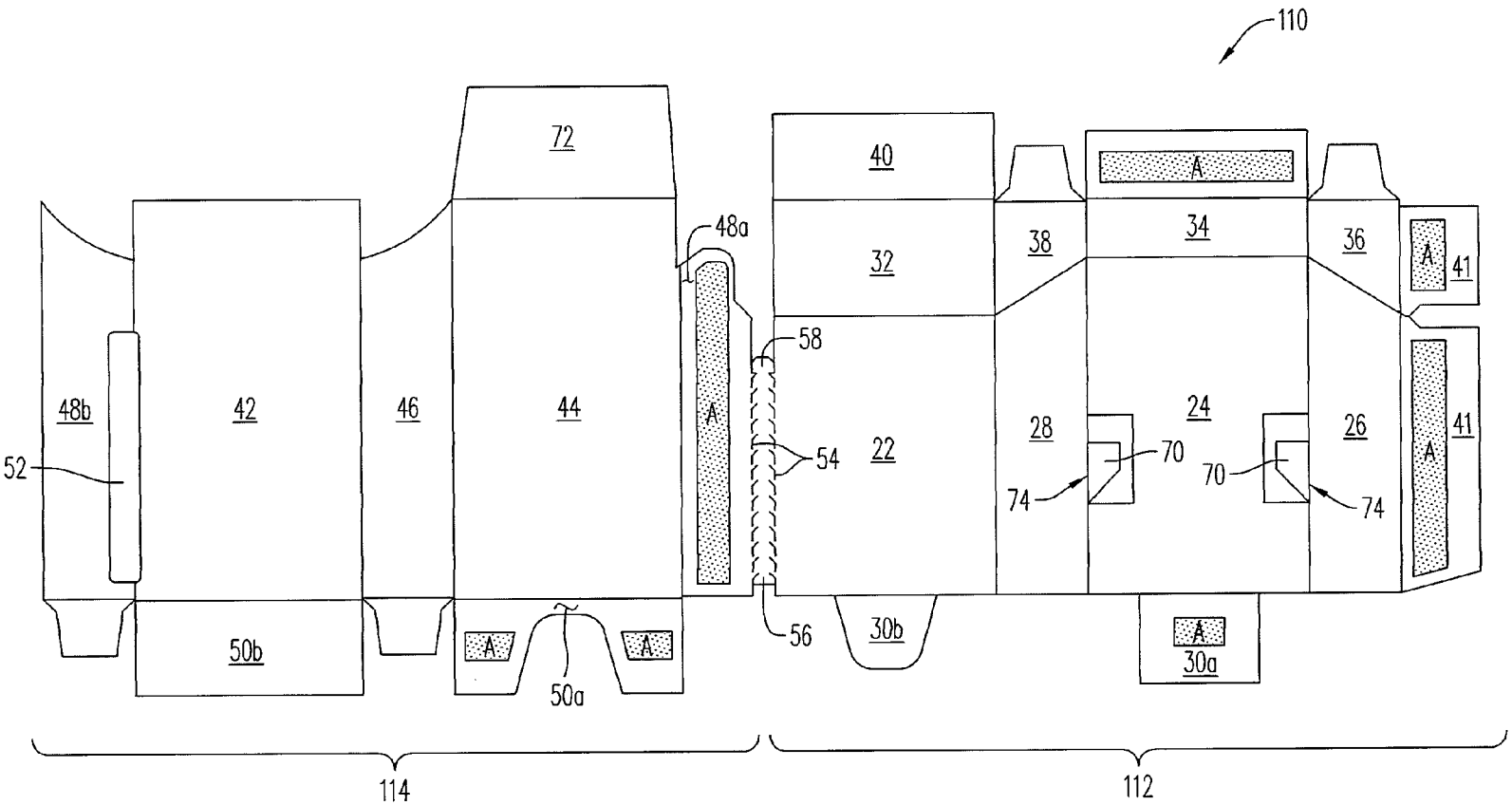
FIG. 4 shows a single laminar blank for forming a slide and shell container as described herein.

Also preferably, the box 16 has a front wall 22, a back wall 24, a left side wall 26, a right side wall 28 and a bottom wall 30 (shown in FIG. 4). The bottom wall 30 does not extend across the entire bottom face of the inner slide 12, but covers only the central portion thereof. The remainder of the bottom face of the inner slide 12 remains open.

Preferably, as shown in FIG. 4, the bottom wall 30 is formed from an inner bottom wall panel 30*a* and an outer bottom wall panel 30*b*. For the reasons set out below, the outer bottom wall panel 30*b* is trapezoidal in shape. The top side of the box 16 is open, to provide an opening through which the smoking articles within the inner slide 12 can be accessed when the hinge lid 18 is opened.

In the preferred embodiment, as shown in FIGS. 3 and 4, the hinge lid 18 includes a front wall 32, a back wall 34, a left side wall 36, a right side wall 38 and a top wall 40. When the hinge lid 18 is closed, the free edges of the walls of the hinge lid 18 abut the upper free edges of the walls of the box 16 along a line of abutment. In the closed lid position of the hinge lid 18, the walls of the hinge lid 18 therefore form extensions of the corresponding walls of the box 16 and the opening in the inner slide 12 is covered by the hinge lid 18.

As can be seen from FIG. 4, an attachment flap 41 extends from the front edges of each of the left side wall of the box 16 and the left side wall of the hinge lid 18. The attachment flaps are used to secure the inner slide 12 in an assembled position and are adhered to the inner surfaces of the front walls of the box 16 and hinge lid 18.

Preferably, the outer shell 14 includes a front wall 42, a back wall 44, a right side wall 46, a left side wall 48 and a bottom wall 50. The top end of the outer shell 14 is open, to allow movement of the inner slide 12 into the open slide position.

In the preferred embodiment, a retention tab 72 is connected to the back wall of the outer shell 14 along a hinge line extending along the top edge thereof. The retention tab 72 is folded by 180 degrees about the hinge line such that it lies between the back wall 44 of the outer shell 14 and the back wall 24 of the inner slide 12. The purpose of the retention tab 72 will be described below.

Preferably, the bottom wall 50 of the outer shell 14 is formed of an inner bottom wall panel 50*a* and an outer bottom wall panel 50*b*. The inner bottom wall panel 50*a* includes a central, generally trapezoidal cut out corresponding approximately in size and shape to the inner bottom wall panel 30*a* of the bottom wall 30 of the inner slide 12.

In the preferred embodiment, the left side wall 48 of the outer shell 14 is formed of an inner left side wall panel 48*a* and an overlying outer left side wall panel 48*b*. Preferably, the outer left side wall panel is provided with a vertical, elongate cut out 52, the purpose of which will be described below.

Also preferably, the container 10 described above may be formed from the laminar blank 110 shown in FIG. 4. The blank 110 includes a slide-defining portion 112 for forming the inner slide 12 and a shell-defining portion 114 for forming the outer shell 14. The slide-defining portion 112 and shell-defining portion 114 are connected to each other along a pair of vertical, parallel lines of perforation 54. The lines of perforation 54 form an opening strip 56 that connects the inner left side wall panel 48*a* of the shell-defining portion 114 and the front wall panel 22 of the box 16 of the inner slide 12. One of the lines of perforation 54 coincides with the left side edge of the box 16 of the inner slide 12 while the other line of perforation 54 extends up the inner left side wall panel 48*a* of the outer shell 14, a short distance apart from the first line of perforation and parallel thereto.

Preferably, the opening strip 56 extends from the bottom of the container to a point just below the line of abutment between the box 16 and hinge lid 18 at the front of the inner slide 12. An opening tab 58 is provided at the top end of the opening strip 56 to make it easier for the opening strip to be grasped by the consumer. The opening tab 58 is connected to the opening strip 56 but is cut away from the remainder of the container 10.

As can be seen from FIG. 1, when the container 10 is assembled, the opening strip 56 coincides with the elongate cut out 52 in the left side wall of the outer shell, adjacent the front edge thereof, such that the opening strip 56 is visible through the cut out 52 and the full length of the opening strip 56, as well as the opening tab 58, are accessible from the outside of the container 10.

Figure 2:
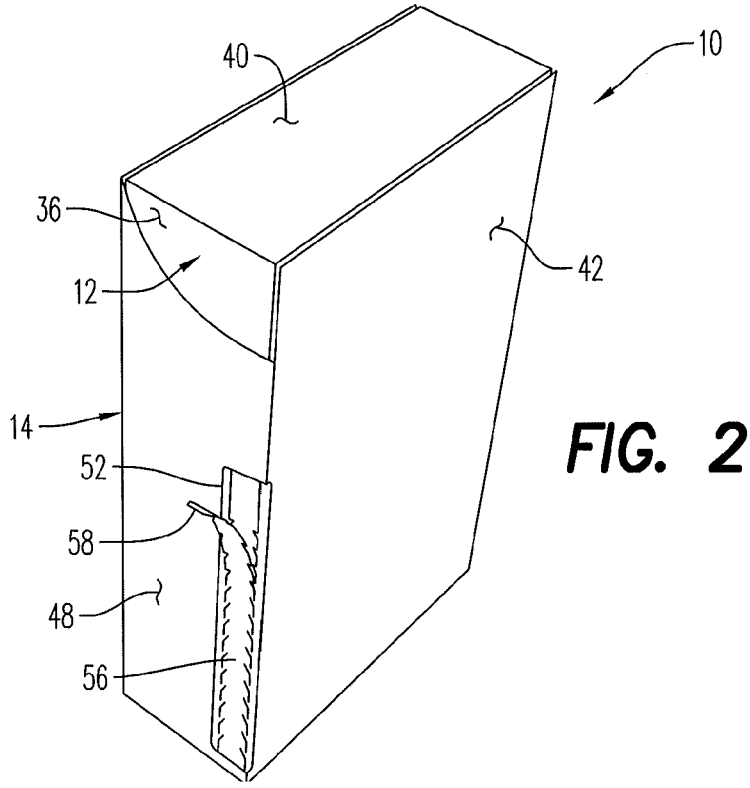
FIG. 2 illustrates the removal of the opening strip from the container of FIG. 1.

FIG. 1 shows the container 10 with the inner slide 12 in a closed slide position and with the opening strip 56 still in place. In the closed slide position, the inner slide 12 is positioned fully within the outer shell 14 so that the hinge lid 18 cannot be opened. The opening strip 58 prevents movement of the inner slide 12 relative to the outer shell 14 such that the inner slide 12 remains in the closed position. In order to access the smoking articles within the inner slide 12, the opening strip 56 must be torn away from the container 10 by breaking the lines of perforation 54 provided along the edges of the strip 56, as shown in FIG. 2.

Once the opening strip 56 has been removed from the container 10, the inner slide 12 and outer shell 14 are no longer connected to each other and the inner slide 12 becomes moveable in a vertical direction between the closed slide position shown in FIG. 1 and the open slide position shown in FIG. 3, in which the hinge lid 18 projects through the top end of the outer shell 14.

In order to move the inner slide 12 to the open slide position, the inner slide 12 may be grasped through the cut outs in the outer shell 14 and pulled upwards through the open end at the top of the outer shell 14. Once the first hinge lid 18 projects from the top end of the outer shell 14, it may then be moved to an open position by pivoting it open about the first hinge line 20.

Once the opening strip 56 has been removed, frictional forces between the outer surfaces of the inner slide 12 and the inner surfaces of the outer shell 14 substantially prevent the inner slide 12 sliding relative to the outer shell 14 until a positive force is applied.

In the preferred embodiment, as shown in FIG. 4, the back wall 24 of the box 16 further includes a pair of retention tabs 70 extending from the side edges thereof, approximately one third of the way up from the bottom of the inner slide 12. Each retention tab 70 has been cut on three sides and is folded 180 degrees about a hinge line 74 extending parallel along the side edge of the back wall. Once the container 10 has been assembled, the pair of retention tabs 70 lies between the back wall 24 of the box of the inner slide 12 and the back wall 44 of the outer sleeve 14.

As the inner slide 12 is moved in an upwards direction, the tabs 70 will move upwards until the free upper edge of each retention tab 70 abuts the bottom edge of the retention flap 72 in the back wall of the outer shell, so that the retention tabs 70 interlock with the outer shell back wall 44. This will prevent further movement of the inner slide 12 in an upwards direction relative to the outer sleeve 14.

In the preferred embodiment, the container 10 may be assembled from the blank 110 in the manner described above. Firstly, the slide-defining portion 112 is folded along its longitudinal, vertical edges and the attachment flaps 41 are adhered to the inner surfaces of the front walls 22,32 of the box 16 and lid 18. The shell-defining portion 114 is also folded along its longitudinal, vertical edges and secured around the partially assembled inner slide 12 by adhering the outer left side wall panel 48*b* to the inner left side wall panel 48*a*, with the elongate cut out 52 in the outer left side wall panel 48*b* overlying the opening strip 56. The retention flap 72 is folded such that it lies between the outer shell 14 and inner slide 12.

The wrapped bundle of smoking articles is then inserted through one of the open ends of the partially assembled container and the panels forming the top wall 40 of the box 16 of the inner slide 12 and the bottom walls 30,50 of the inner slide 12 and outer shell 14 are then folded closed using a standard packing machine. Areas of adhesive (indicated as areas 'A') are applied to the panels of the blank 110 in the positions shown such that when the panels are folded, the inner 30*a* and outer 30*b* bottom wall panels of the inner slide 12 are adhered to each other and similarly, the inner 50*a* and outer 50*b* bottom wall panels of the outer shell are adhered to each other.

As described above, this efficient folding and gluing sequence is only possible because of the cut out portion in the inner bottom wall panel 50*a* of the outer shell 14, through which the outer bottom wall panel 30*b* of the inner slide 12 can be adhered to the corresponding inner bottom wall panel 30*a*. Without this cut out, the flaps would overlap such that adhesive could not be applied in the appropriate places.

In this specification, the word "about" is sometimes used in connection with numerical values to indicate that mathematical precision is not intended. Accordingly, where the word "about" is used with a numerical value, that numerical value should be interpreted to include a tolerance ±10% of the stated numerical value.

It will now be apparent to those skilled in the art that the foregoing specification describes with particularity a slide and shell container having a tamper evident seal. Moreover, it will also be apparent to those skilled in the art that various modifications, substitutions, variations, and equivalents exist for claimed features of container. Accordingly, it is expressly intended that all such modifications, substitutions, variations, and equivalents for claimed features of the container, which fall within the spirit and scope of the invention as defined by the appended claims, be embraced thereby.

We claim:

1. A slide and shell container comprising:

an outer shell including a shell front wall, a shell back wall, a shell bottom wall, a first shell side wall and a second shell side wall;

an inner slide, wherein the inner slide is mounted within the outer shell and includes a hinge lid connected to the inner slide about a hinge line, a slide front wall, a slide back wall, a first slide side wall and a second slide side wall, the hinge lid including a front wall, a back wall, a top wall, a first side wall and a second side wall; and at least one retention flap provided on the inner slide which is capable of engaging with the outer sleeve to prevent movement of the inner slide beyond the open slide position, wherein the outer shell and the inner slide are detachably connected to each other along one or more lines of weakness extending partially along the first shell side wall, wherein upon separation of the outer shell and inner slide along the one or more lines of weakness, the inner slide becomes slidable within the outer shell between a closed slide position and an open slide position, and wherein in the closed slide position the hinge lid is retained in a closed position by the outer shell and in the open slide position the hinge lid is moveable to an open position.

2. The container of claim 1, wherein the outer shell and inner slide are detachably connected to each other along two or more lines of weakness defining an integral opening strip which is separable from the container in order to separate the outer shell from the inner slide.

3. The container of claim 2, wherein one of the two or more lines of weakness extends along a left side edge of the inner slide and a second one of the two or more lines of weakness extends along an inner left side wall panel of the outer shell.

4. The container of claim 3, wherein the integral opening strip connects the inner left side wall panel of the shell and the slide front wall panel.

5. The container of claim 2, wherein the integral opening strip coincides with an elongate cut out such that the integral opening strip is visible through the cut out.

6. The container of claim 1, wherein in the closed slide position the hinge lid is retained in a closed position by the outer shell and in the open slide position the hinge lid is moveable to an open position.

7. The container of claim 1, wherein prior to separation of the outer shell and the inner slide along the one or more lines of weakness, the inner slide is held in the closed slide position.

8. The container of claim 1, wherein the inner slide further includes a bottom slide wall.

9. The container of claim 1, further including retention means for preventing removal of the inner slide from the outer shell.

10. The container of claim 9, wherein the retention means includes at least one retention flap provided on the inner slide which is capable of engaging with the outer sleeve to prevent movement of the inner slide beyond the open slide position.

11. The container of claim 10, further including at least one retention tab operable to interlock with the at least one retention flap.

12. The container of claim 1, wherein the outer shell and inner slide are formed together of a single laminar blank including the one or more lines of weakness.

13. The container of claim 1, wherein an opening tab is provided along the one or more lines of weakness.

14. The container of claim 1, wherein the inner slide houses a plurality of smoking articles.

* * * * *